US005272791A

United States Patent [19]

Rimmer

[11] Patent Number: 5,272,791

[45] Date of Patent: Dec. 28, 1993

[54] CARDING MACHINE

[75] Inventor: Michael J. Rimmer, Halifax, United Kingdom

[73] Assignee: Carding Specialists (Canada) Ltd., Toronto, Canada

[21] Appl. No.: 59,505

[22] Filed: May 10, 1993

Related U.S. Application Data

[63] Continuation of Ser. No. 955,475, Oct. 2, 1992, abandoned, which is a continuation of Ser. No. 651,430, Feb. 5, 1991, abandoned.

[30] Foreign Application Priority Data

Feb. 6, 1990 [GB] United Kingdom ..... 9002595

[51] Int. Cl.[5] ..... D01G 15/02

[52] U.S. Cl. ..... 19/102

[58] Field of Search ..... 19/98, 102, 103, 108, 19/110, 111, 113

[56] References Cited

U.S. PATENT DOCUMENTS

| | | | |
|---|---|---|---|
| 1,148,708 | 8/1915 | Morton | 19/111 |
| 1,479,639 | 1/1924 | Albrecht | 19/111 |
| 3,321,810 | 5/1967 | Burnham | 19/111 |
| 4,128,917 | 12/1978 | Varga | 19/98 |
| 4,559,674 | 12/1985 | Rimmer et al. | 19/102 |
| 4,757,474 | 7/1988 | Varga | 19/103 |
| 4,797,978 | 1/1989 | Giuliani | 19/98 |

FOREIGN PATENT DOCUMENTS

| | | | |
|---|---|---|---|
| 172691 | 1/1935 | Switzerland | 19/102 |

*Primary Examiner*—Clifford D. Crowder
*Assistant Examiner*—Michael A. Neas
*Attorney, Agent, or Firm*—Darby & Darby

[57] ABSTRACT

A carding machine comprises a first carding cylinder, a roller and plate for feeding material to be carded on to the first carding cylinder, a second carding cylinder, a roller and takerin for transferring material from the first to the second carding cylinder, and a roller for stripping carded material from the second carding cylinder. The first and second carding cylinders are driven in the same direction of rotation. A single set of flats is driven along a closed path, parts of which pass immediately adjacent to an arc of the circumference of each of the first and second carding cylinders. The flats thus cooperate in carding actions with both carding cylinders in turn.

7 Claims, 1 Drawing Sheet

CARDING MACHINE

This is a continuation of application Ser. No. 07/955,475, filed Oct. 2, 1992, now abandoned, which is a continuation of Ser. No. 07/651,430, filed Feb. 5, 1991, now abandoned.

This invention relates to a carding machine.

The conventional cotton carding machine comprises a feed roller and feed plate for feeding material to be carded to a takerin. The takerin transfers the material onto a carding cylinder and flats cooperate with an arc of that cylinder so that a carding effect takes place between carding elements on the cylinder and on the flats. The carded material is removed from the cylinder by a doffer, and is stripped from the doffer and delivered from the machine. The flats may be either stationary or may travel in a closed path, part of which closely follows the working arc of the cylinder.

When higher carding performance is required it is also known to use a so-called duo-card, for example as shown in GB-A-1024541. A duo card has first and second carding cylinders, each with its own separate set of flats, and material doffed from the first cylinder is transferred by a center section of the machine to a takerin for the second cylinder. It will be appreciated that the two sets of carding actions, coupled with the working that takes place in the center of the carding machine can result in a cleaner web being delivered from the machine.

Duo-cards have in the past been significantly more expensive than single cylinder carding machines, and a need is perceived for a machine which is more efficient than the single cylinder carding engine and yet which is significantly cheaper than the known duo-cards. The invention seeks to provide such a machine.

According to the invention a carding machine comprises a first carding cylinder, means for feeding material to be carded on to the first carding cylinder, a second carding cylinder, a plurality of transfer rollers for stripping material from the first carding cylinder and transferring it to the second carding cylinder, the cylinders and rollers having parallel axes and being of substantially equal axial length. The machine also comprises means for stripping carded material from the second carding cylinder and delivering the carded material from the machine, drive means for driving the first and second carding cylinders in the same sense of rotation and for driving the transfer rollers. Further included in the machine are a plurality of flats each comprising a flat bar of length at least equal to the axial length of each cylinder, each flat bar extending parallel to the cylinder axes and supporting carding elements, means linking each flat to the two immediately adjacent flats to form a closed chain of flats, and means for driving the chain of flats so that each flat travels in a closed path parts of which pass immediately adjacent to an arc of the circumference of each of the first and second carding cylinders. Thereby the carding elements cooperate in a carding action firstly with carding elements on one of the carding cylinders, and then with carding elements on the other of the carding cylinders. The crux of the invention is that a single set of moveable flats cooperate with both carding cylinders. The drive system for the carding machine can thus be simplified over that of the conventional duo card, and costs can be cut significantly while still retaining high carding efficiency.

Preferably the transfer rollers comprise a doffer for removing material directly from the first carding cylinder and a takerin for removing material directly from the doffer and transferring it directly on to the second carding cylinder. This direct transfer using a minimum number of rollers in the center section further reduces the cost, and indeed makes possible the manufacture of the new machine at a cost little higher than that of a single cylinder carding machine.

In order that the invention may be better understood embodiments of a carding machine in accordance therewith will now be described in more detail, by way of example only, with reference to the accompanying drawings in which.

Figure 1:
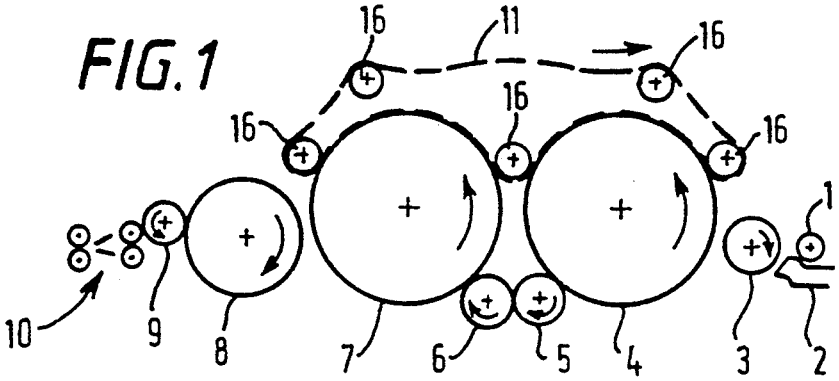
FIG. 1 is a schematic drawing of a first embodiment of carding machine.

Referring now to FIG. 1 this shows a carding machine comprising a feed roller 1 and feed plate 2, a takerin 3 delivering material from the feed system to a first carding cylinder 4 and a centre section comprising a doffer 5 and second takerin 6. The doffer removes material directly from the first carding cylinder 4, and the takerin removes material directly from the doffer. The material from the second takerin is transferred directly onto a second carding cylinder 7 from which material is doffed by a doffer 8. A stripping roller 9 takes the carded web from the doffer 8 to any conventional delivery arrangement such as a condenser trumpet and sliver-forming rollers 10.

The takerin cylinders, doffers and stripping roller all have parallel axes and are all of substantially equal axial length. Suitable drive motor and transmission means are provided to drive the rotating elements in the senses shown by arrows, it being important that the cylinders 4 and 7 are driven in the same sense of rotation. The drive arrangement as such is not part of the invention and suitable arrangements will readily be apparent to those skilled in the art.

Figure 2:
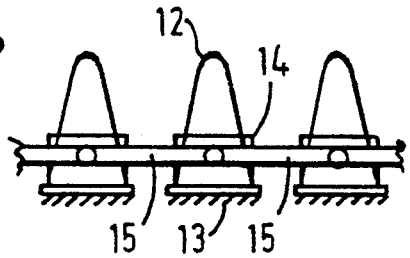
FIG. 2 is a schematic end elevation of a plurality of individual flats.

The carding machine is provided with a single set of flats 11. As shown schematically in FIG. 2, each flat comprises a flat bar 12 supporting carding elements 13. Each flat bar is at least equal in length to the axial length of the cylinders and extends parallel to the cylinder axes. Each flat bar has support means 14 at each end, and is linked at each end to the two immediately adjacent flats by pivotal links 15 so as to form a closed chain of flats. Again, detailed flat construction and linkage will be apparent to those skilled in the art. It is particularly preferred for the flats to be constructed as disclosed in US-A-4559674 the entire contents of which are hereby incorporated by reference. The closed chains of flats pass around block wheels 16, at least one of which is driven, and it will be seen that as the flats travel along their closed path they pass immediately adjacent to an arc of the circumference of each of the first and second carding cylinders. When travelling over those arcs the flats are supported so that the support means 14, at their ends run on bends provided in conventional manner to each side of the carding cylinder. The carding elements 13 on the flats thus cooperate in a carding action firstly with carding elements on cylinder 4 and then with carding elements on cylinder 7.

The number and spacing of the flat bars provided in the series of flats may be selected in accordance with the degree of carding required for the particular feed stock, and the choice of the particular card clothing selected for the flats may be similarly dictated.

The single set of flats, requiring only a single drive to all flats and only a single cleaning arrangement for the flats, together with the minimal roller arrangement in the center transfer section of the carding machine, enables the machine to be manufactured at a cost that is little higher than the cost of a single cylinder machine.

Figure 3:
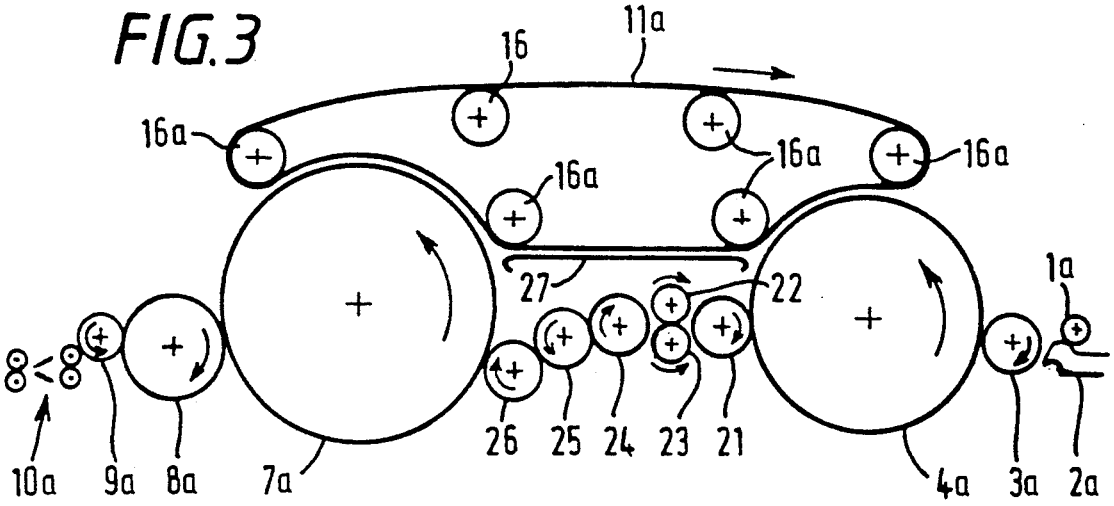
FIG. 3 is a schematic drawing of a second embodiment of carding machine.

Although the main benefit of the invention is achieved with the minimum transfer section as shown in FIG. 1 between the two carding cylinders it will be appreciated that other transfer sections are possible. One such is illustrated in FIG. 3, wherein parts similar to parts of FIG. 1 are given the same reference numeral with the suffix a. In this embodiment, the center section comprises a doffer 21 from the first carding cylinder, feeding the web between a pair of smooth surfaced crush rollers 22, 23. The web is taken from the crush rollers by transfer rollers 24, 25 to a takerin 26 for the second carding cylinder 7*a*. This extended centre section requires a longer path of travel for the flats 11*a* between the two cylinders, so that additional block wheels 16*a* as shown are necessary. It is also advisable to separate the flats from the rollers of the center section by a guard 27 to prevent any waste falling from the flats on to those rollers.

Other center section arrangements can be used if desired.

I claim:

1. A carding machine for a web of fibers comprising a first carding cylinder having carding elements rotatable in one direction, means for feeding said web to be carded on to the first carding cylinder, a second carding cylinder having carding elements rotatable in the same direction as the first carding cylinder, a plurality of transfer rollers for stripping said web from the first carding cylinder and for transferring it to the second carding cylinder, the cylinders and rollers having parallel axes, means for stripping the carded web from the second carding cylinder and delivering the twice-carded web from the machine, a plurality of flats each comprising a flat bar, each said flat bar extending parallel to the cylinder axes and supporting carding elements, means linking each said flat to the two immediately adjacent flats to form a closed chain of flats, and means for guiding the chain of flats so that each flat travels in a closed path, parts of said path passing immediately adjacent to an arc of the circumference of each of the first and second carding cylinders, respective groups of said flats forming respective arcs of said path cooperating simultaneously with corresponding arcs on the surfaces of said carding cylinders, the carding elements on said flats cooperating in a carding action firstly with carding elements on the first carding cylinder, and then with carding elements on the second carding cylinder.

2. A carding machine according to claim 1 in which the transfer rollers comprise a doffer for removing said web directly from the first carding cylinder and a takerin for removing said web directly from the doffer and transferring it directly on to the second carding cylinder.

3. A carding machine according to claim 1 in which the arcs are upper arcs of the cylinders, the closed path of the flats extends above the transfer rollers and a guard extends in the space between the closed path and the transfer rollers.

4. A carding machine according to claim 2 in which the arcs are upper arcs of the cylinders, the closed path of the flats extends above the transfer rollers and a guard extends in the space between the closed path and the transfer rollers.

5. A carding machine comprising a first carding cylinder having carding elements rotatable in one direction, means for feeding material to be carded onto the first carding cylinder, a second carding cylinder having carding elements rotatable in the same direction as the first carding cylinder, a plurality of transfer rollers for stripping material from the first carding cylinder and delivering material to said second cylinder, means for stripping carded material from the second carding cylinder and delivering the carded material from the machine, a plurality of flats, each flat comprising a bar supporting carding elements, connection means for forming a closed chain of said flats, and means for guiding the chain of flats so that each said flat travels in a closed path, parts of said path passing immediately adjacent to an arc of the circumference of each of the first and second carding cylinders, respective groups of said flats forming respective arcs of said path cooperating simultaneously with corresponding arcs on the surfaces of said carding cylinders, the carding elements on said flats cooperating in a carding action firstly with carding elements on the first carding cylinder, and then with carding elements on the second carding cylinder.

6. A carding machine as in claim 5, wherein said parts of said path immediately adjacent to said circumferential arcs are concentric with the associated circumferential arc.

7. A carding machine as in claim 1, wherein said flats move at the same velocity through each said arc.

* * * * *